US005178453A

United States Patent [19]

Runels

[11] Patent Number: 5,178,453

[45] Date of Patent: Jan. 12, 1993

[54] MOUNTING ASSEMBLY FOR PORTABLE ARTICLES

[76] Inventor: Thomas L. Runels, 136 S. Lincoln Blvd., Battle Creek, Mich. 49015

[21] Appl. No.: 752,040

[22] Filed: Aug. 29, 1991

[51] Int. Cl.[5] ..... F21V 21/08

[52] U.S. Cl. ..... 362/398; 362/191; 362/404; 362/368; 248/206.5

[58] Field of Search ..... 362/147, 186, 190, 191, 362/404, 382, 407, 398, 362, 368; 248/206.5, 309.4

[56] References Cited

U.S. PATENT DOCUMENTS

| | | | |
|---|---|---|---|
| 2,279,933 | 4/1942 | Wells . | |
| 2,654,022 | 3/1953 | Adamy et al. | 362/398 |
| 3,518,884 | 7/1970 | Wood, Jr. . | |
| 3,836,766 | 9/1974 | Auerbach | 362/398 |
| 4,079,243 | 3/1978 | Pemberton . | |
| 4,506,317 | 3/1985 | Duddy . | |
| 4,538,214 | 8/1985 | Fisher et al. . | |
| 4,617,612 | 10/1986 | Pritchett | 362/398 |
| 5,067,059 | 11/1991 | Hwang | 362/398 |

*Primary Examiner*—Richard R. Cole
*Attorney, Agent, or Firm*—Varnum, Riddering, Schmidt & Howlett

[57] ABSTRACT

An assembly is provided which is portable and which includes a cuplike base having mounted therein an article such as a lamp unit. The base is provided with a cover which normally protects the article and renders the same readily portable and for storage. The base or the cover or both are provided with magnetic surfaces for mounting the article on a flexible panel such as the type formed of fabric or cloth mas may be found, for example, in a tent. In one embodiment, the article is a lamp unit which may be of several forms including a simple lamp socket suspended from the lamp cord. The lamp unit may also be in the form of a fixed lamp socket retained within the base by a special lens. On the other hand, the lamp socket may be carried by a plurality of arms which are pivotally mounted to one another so as to projectable from within the base to a depending position supporting the lamp socket.

19 Claims, 5 Drawing Sheets

MOUNTING ASSEMBLY FOR PORTABLE ARTICLES

This invention relates in general to new and useful improvements in mounting devices, and more particularly to a mounting assembly for portable articles or devices such as lamps which are intended to be suspended from a flexible panel formed of fabric or cloth, such as may be found in a tent.

BACKGROUND OF THE INVENTION

It is known to suspend articles on opposite surfaces of a support. For example, U.S. Pat. No. 3,518,884 to Wood, Jr. teaches that magnets may be utilized to support thermometers on opposite sides of a vertical glass pane. U.S. Pat. No. 4,538,214 to Fisher et al. teaches that an illumination system may be suspended from a fixed ceiling panel for sliding movement relative to that ceiling panel to accurately position the light. The system includes an upper mechanism positioned above the ceiling panel and a lower mechanism positioned below the ceiling panel with there being no physical connections between the two mechanisms. The two mechanism include electrical coils which induce current from the upper mechanism into the lower mechanism for powering the lamp. These induction coils also function as electromagnets which serve to suspend the lower mechanism from the upper mechanism through the ceiling panel.

It is also known to provide portability for articles such as lamps and the like whereby they can be adapted for use in situations where the normal amenities of modern life are not readily available. For example, in hiking and camping, it is useful to have articles such as lamps, clocks, hangers, and the like to be lightweight, portable, protected from the elements, and capable of easy use in wilderness areas. There is a need for a simple, self-contained, portable assembly which will contain an article such as a lamp for storage and transport and also be capable of mounting the article to a flexible panel such as the wall of a tent.

SUMMARY OF THE INVENTION

This invention particularly relates to an assembly for supporting an article on a flexible panel. The assembly includes a hollow base having an open end closed by a cover. In one aspect of the invention, the article is a lamp unit so the base carries a battery tray for receiving a DC battery power supply with the battery box being positioned to provide storage space for a lamp to one side of the battery box. The lamp may be provided with a detachable hood positioned to an opposite side of the battery box. The lamp may either be directly mounted within the base or may be provided with suitable suspension means carried by the base.

In another aspect, the cover normally closes the base and completely encloses the article for handling and storage.

Further, in accordance with this invention, the base has a surface which has magnetic properties. The cover also has a surface with magnetic properties of opposite polarity so the surfaces will be attracted to each other. Either surface or both may be defined by magnets. When it is desired to mount the article, the cover is placed on one side of the flexible panel, typically a tent, in an inverted position. The base is then inverted and pressed against the other side of the flexible panel in alignment with the cover with the two magnetic surfaces serving to coact and hold the base in a selected position relative to the panel.

With the above and other objects in view that will hereinafter appear, the nature of the invention will be more clearly understood by reference to the following detailed description, the appended claims, and the several views illustrated in the accompanying drawings.

BRIEF DESCRIPTION OF THE DRAWINGS

The invention will now be described with reference to the following drawings in which.

DESCRIPTION OF PREFERRED EMBODIMENT OF INVENTION

Figure 1:
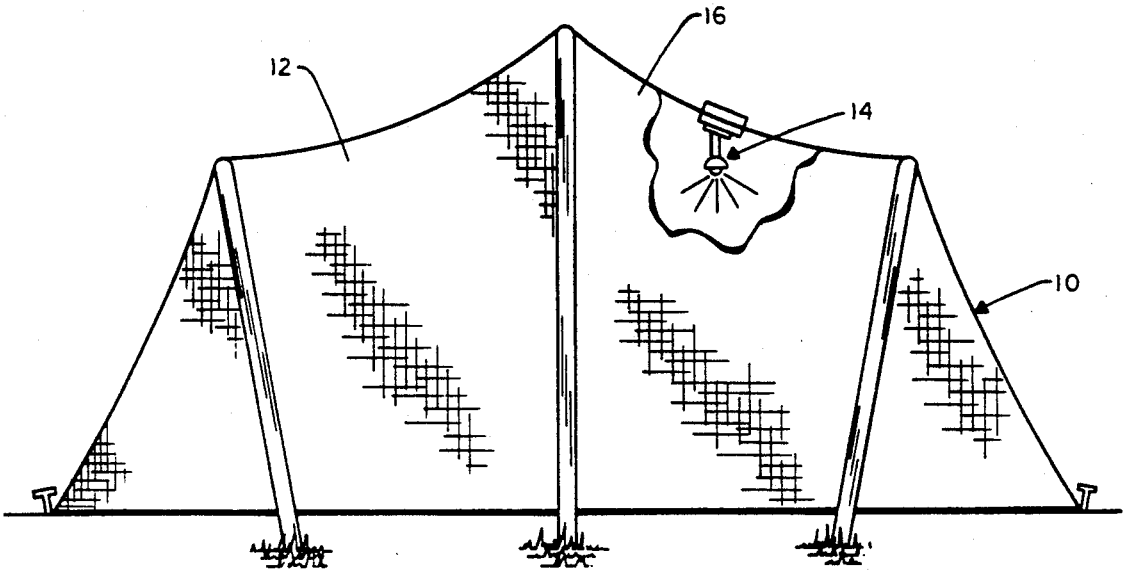
FIG. 1 is a schematic view of a tent having suspended from the roof thereof a portable lamp with a mounting assembly in accordance with this invention.

Referring now to the drawings in detail, reference is first made to FIG. 1 wherein there is illustrated a typical usage of the mounting assembly which is the subject of this invention. Although the mounting assembly of the invention is illustrated in the embodiment of a portable lamp, it is understood that the invention is not so limited. The device is equally adaptable to any relatively small article which can be mounted in a compact, portable container, such as a clock, an air freshener, a hanger, a small radio, etc. The use of such items is enhanced when they can be removably mounted to a flexible wall, such as the wall of a tent.

In FIG. 1 there is illustrated a conventional type of tent generally identified by the numeral 10. The tent 10 comprises a fabric or cloth covering 12. Such covering typically comprises multiple, flexible panels formed of canvas or synthetic material. The lamp assembly, which embodies the subject of this invention and generally identified by the numeral 14, is illustrated as supported by an upper portion 16 of the tent fabric 12 with the lamp assembly being in suspended relation within the tent 10.

Figure 2:
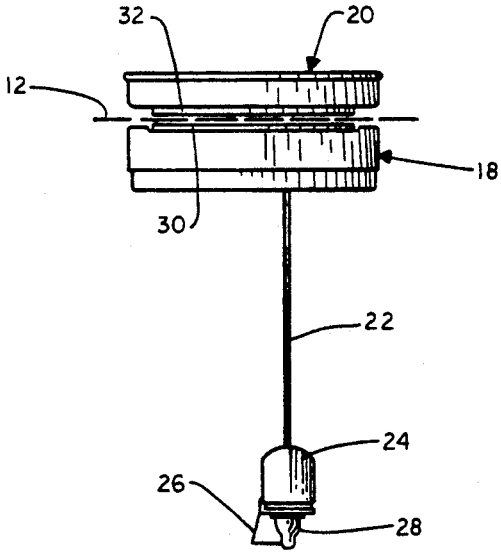
FIG. 2 is an enlarged fragmentary elevational view showing more specifically the details of the assembly and its mounting with respect to the tent.

Reference is next made to FIG. 2 wherein the lamp assembly is illustrated in its use position. It will be seen that the lamp assembly includes a base 18 with a removable cover 20, adapted to coact to form a closable container. The base 18 has suspended therefrom an electrical cord 22 which, in turn, supports a lamp socket 24. The lamp socket 24 is provided with a removable hood 26 for directing light from a bulb 28 carried by the lamp socket 24.

In the position illustrated in FIG. 2, the base 18 carries a flat magnet 30 which is of opposite polarity to a flat magnet 32 carried by the cover 20, each magnet having a surface thereby attracted to the other. Because of the portability of the assembly, it will be apparent that the magnets 30, 32 are permanent in the sense that their magnetic fields are not generated by an applied electrical current. The magnets 30, 32 are of a strength so as to support the lamp assembly beneath the tent cloth or fabric 12 as illustrated in FIG. 2 and preferably have a significant facing area, relative to the thickness and weight of the magnets. It is to be understood that only one magnet is necessary if the separable part of the lamp is formed of a material that is attracted to the magnet. For example, the base may carry the flat magnet 30 while the cover 20 is metallic.

Figure 3:
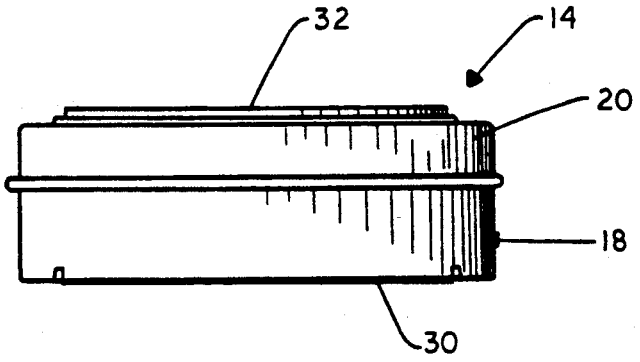
FIG. 3 is an elevational view of the assembly in its closed position ready for transport and storage.

The base 18 is of a hollow construction with all of the components of a lamp unit being storable therein as is best shown in FIG. 3. The cover 20 is then utilized to close the open top of the base 18 to form the container for storage or transport.

Figure 4:
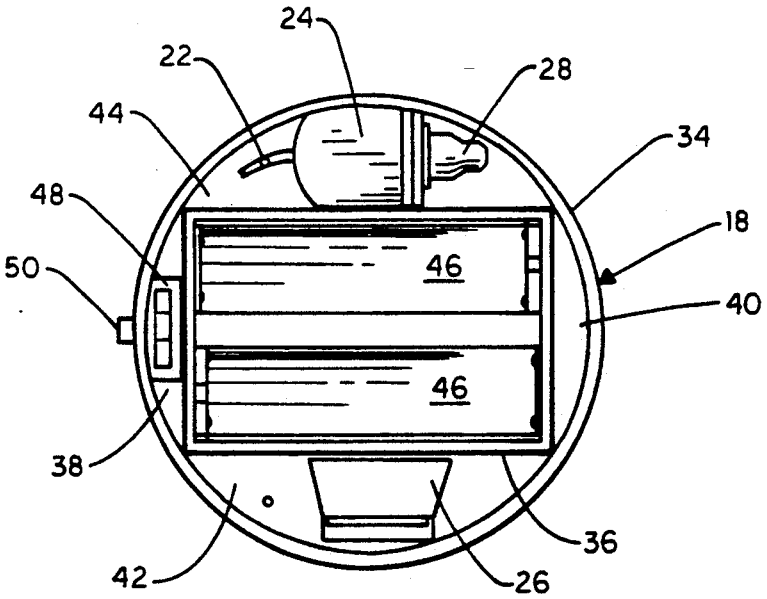
FIG. 4 is a plan view of the assembly with the cover removed and shows the arrangement of the components of an article within the base.

Referring now to FIG. 4, it will be seen that the base 18 is circular in outline and is provided with an upstanding cylindrical wall 34. A rectangular battery box 36 is seated within the base 18 and is of a size so as to generally engage at each of its four corners the upstanding wall 34. The battery box 36, in combination with the wall 34, defines end storage areas 38, 40 and side storage areas 42, 44. The battery box 36 is of a configuration to receive in electrical conducting relation a pair of DC batteries 46.

In the end storage area 38 there is positioned a switch unit 48. The switch unit 48 is provided with an AC inlet fitting 50 which projects through the wall 34 for receiving a pin type connector leading from an AC transformer (not shown). The switch unit 48 is utilized to selectively couple the lamp socket 24 and the bulb 28 carried thereby either with the AC energy source or with the DC batteries 46. Thus the switch unit 48 has three positions including an OFF position, a DC position and an AC position.

It will be seen that the lamp socket 24 and the bulb 28 as well as the cord 22 are stored in the side storage area 44 while the hood 26 is stored in the side storage area 42.

Figure 5:
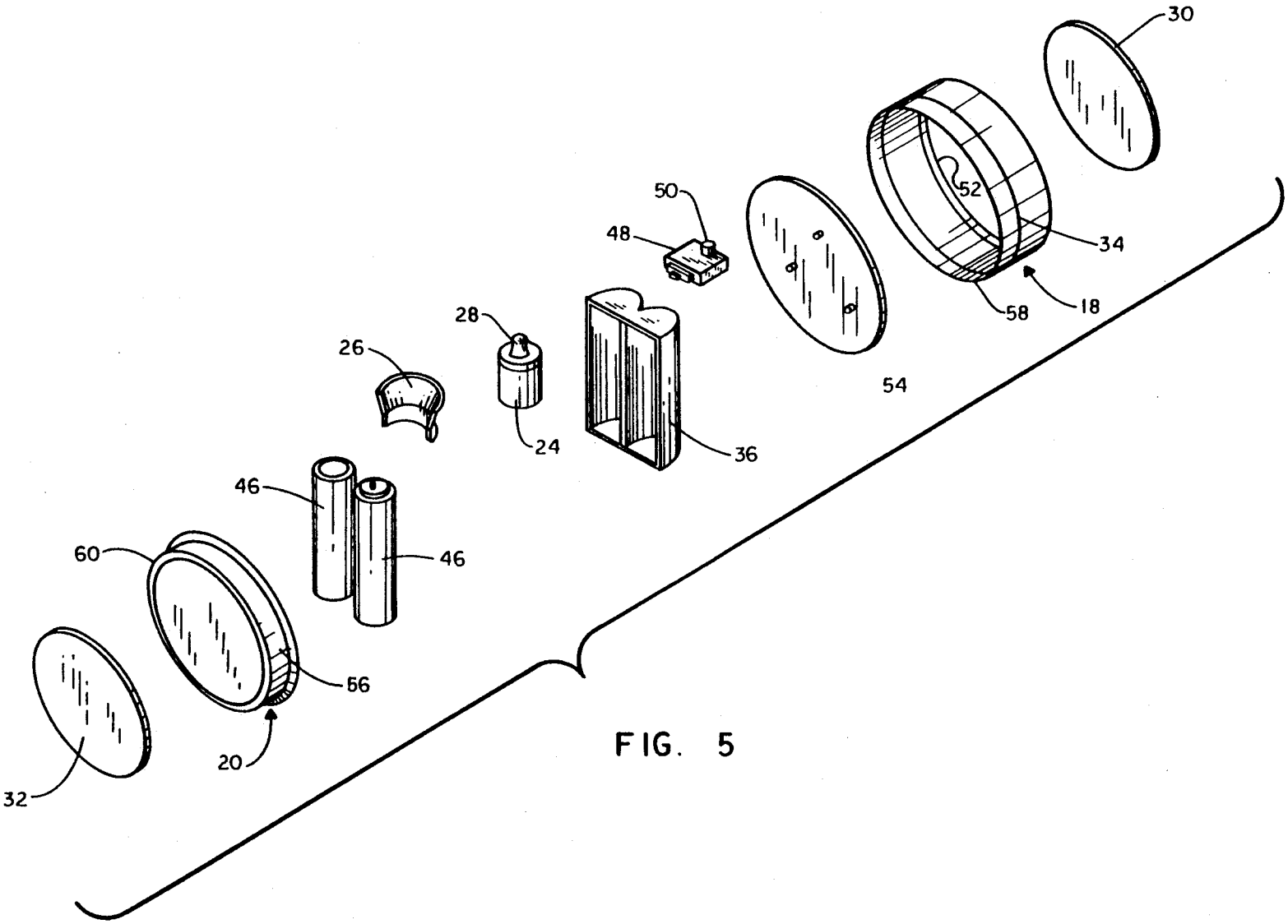
FIG. 5 is an exploded perspective view showing the details of the various components of the assembly of FIG. 4.

Reference is now made to FIG. 5 wherein the specific details of the various components of the light assembly 14 are illustrated. First of all, it will be seen that the base 18 is generally cup shaped and in addition to the upstanding wall 34 includes a recessed at least partial bottom 52 for receiving in recessed seating relation the magnet 30. As can be seen, the recessed bottom 52, as well as the magnet 30 received thereby, extends over substantially most of the area of the bottom of the base 18. Preferably, the diameter of the base 18 and cover 20 is greater than the combined length of the cylindrical shape formed by the base 18 and cover 20. Positioned within the base 18 and being seated on the interior of the wall 52 is a PC board 54. The aforementioned battery box 36 and the switch unit 48 are mounted on the PC board 54. The cord 22 is not illustrated. However, it is to be understood that it extends from the switch unit 48 to the lamp socket 24.

The cover 20 is also generally cup shaped and includes a skirt 56 which is of an internal diameter to snugly be received over a reduced diameter cylindrical flange portion 58 of the wall 34. The cover 20 includes an at least partial top wall 60 which carries the magnet 32.

Figure 6:
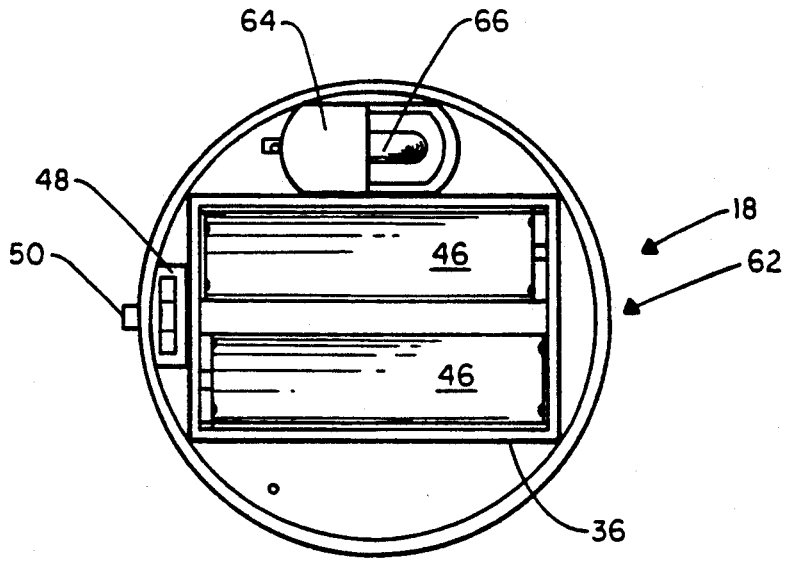
FIG. 6 is a plan view similar to FIG. 4 of a slightly modified form of the assembly of FIG. 5.

Reference is now made to FIG. 6 wherein there is illustrated a modified form of portable lamp assembly generally identified by the numeral 62. The portable lamp assembly 62 is of the same basic construction as the lamp assembly 14 with only the interior of the base 18 being specifically illustrated. The base 18 is provided with the battery box 36 which carries the two batteries 46. The base 18 also carries the switch assembly 48 including the projecting adaptor pin 50.

The lamp assembly 62 differs from the lamp assembly 14 only in the details of the specific lamp element which includes a special socket with hood 64. The socket 64 carries a conventional bulb 66.

Figure 7:
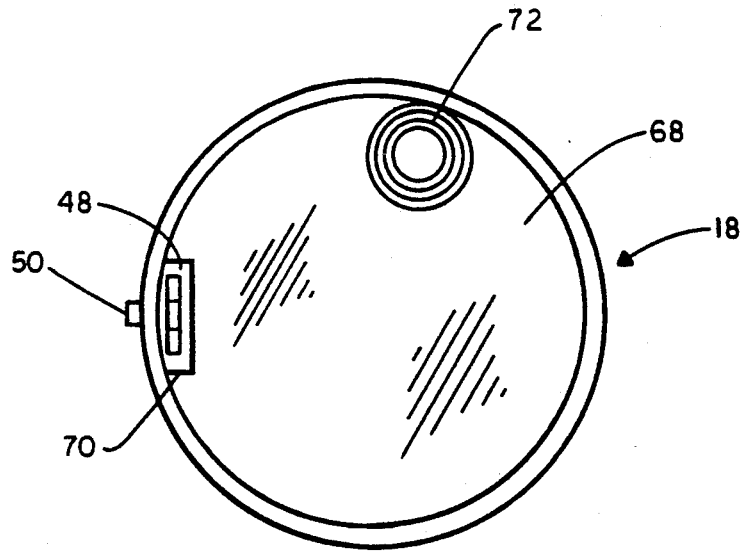
FIG. 7 is a bottom plan view of the base of FIG. 6 showing the details of a lens closing the base and cooperating with the lamp socket within the base.

The socket with hood 64 is fixedly mounted within the base 18 as the open end thereof is closed by a lens 68 as shown in FIG. 7. The lens 68 is provided with a cutout 70 for the switch assembly 48 and has a special lens portion 72 underlying the bulb 66. The lens 68 is adapted to remain in place when the cover 20 encloses the lamp assembly 62.

Figure 8:
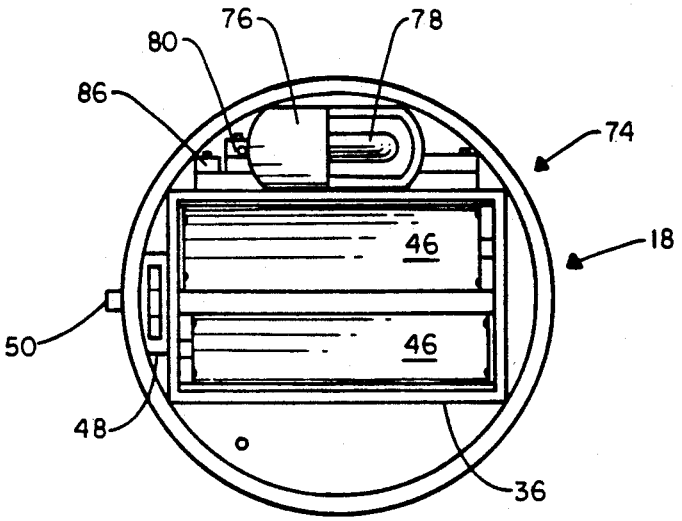
FIG. 8 is another plan view similar to FIG. 4 of yet another form of an assembly wherein a lamp is suspended by a foldable arm.
Figure 9:
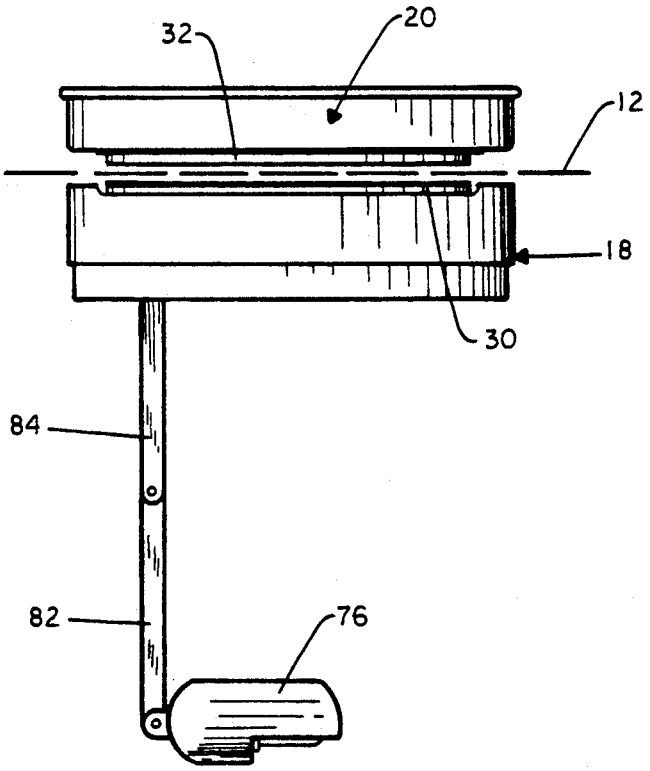
FIG. 9 is an elevational view of the lamp of FIG. 7 extended in its operative position.

Referring now to FIGS. 8 and 9, it will be seen that there is illustrated still another form of portable lamp assembly generally identified by the numeral 74. The lamp assembly 74 incorporates the basic base 18 construction which has mounted therein the battery box 36 carrying two batteries 46. The base 18 also carries the switch assembly 48 and the adaptor pin 50.

The lamp assembly 74 differs from the lamp assembly 14 only in the details of the lamp socket and the mounting thereof. The lamp socket is in the form of a combination socket and hood 76 corresponding generally to the socket and hood 64 and carries a bulb 78. The lamp socket, however, is mounted for movement out of the base 18 to a lower suspended position as is shown in FIG. 9.

As is best shown in FIG. 8, the lamp socket 76 is provided with a rearwardly directed mounting ear 80 which is pivotally connected to a free end of a support rod 82. The support rod 82 is, in turn, pivotally mounted on one end of a second support rod 84 which has the opposite end thereof pivotally connected to a mounting ear 86 (FIG. 8) carried by the base 18.

As will be readily apparent from FIG. 8, the rod sections 82, 84 may be pivoted relative to each other and the base so as to be completely disposed within the base 18 beneath the lamp socket 76 as is clearly shown in FIG. 8.

Although only several preferred embodiments of lamp assemblies have been specifically illustrated and described herein, it is to be understood that variations may be made in the lamp assemblies and other useful devices may be incorporated into the container without departing from the spirit and scope of the invention as defined by the appended claims.

The embodiment of the invention in which an exclusive property or privilege is claimed are defined as follows:

1. An assembly for supporting an article on a flexible panel, said assembly comprising a base carrying the article, and a cover for the base to substantially enclose the article therein, each of said base and said cover having a surface with permanent magnetic properties of opposite polarity whereby the surfaces can be disposed on opposite sides of the flexible panel to magnetically clamp the flexible panel therebetween.

2. An assembly according to claim 1 wherein said cover is generally cup shaped with a top wall and has a magnet engaging said top wall externally of said cover.

3. An assembly according to claim 2 wherein said base is hollow and includes a recessed bottom wall, and a magnet is seated in the recessed bottom wall externally of said base.

4. An assembly according to claim 1 wherein said base is hollow and of a size and shape to receive therein said article in its entirety and said cover is engageable with said base to completely enclose said article for transport and storage.

5. An assembly according to claim 4 wherein said article is a lamp unit which includes a lamp socket fixedly mounted in said base.

6. An assembly according to claim 4 wherein said base has an open end closed by a lens.

7. An assembly according to claim 4 wherein said article is a lamp unit which includes a lamp socket carried by an arm unit for swinging movement between a stored position within said base and a suspended depending position.

8. An assembly according to claim 4 wherein said article is a lamp unit which includes a lamp socket carried by a power cord for movement between a stored position within said base and a depending position.

9. An assembly according to claim 8 wherein said lamp socket has a separate detachable hood for separate storage within said base.

10. An assembly according to claim 9 wherein there is a battery box centrally located within said base and providing two storage spaces, one storage space on each side of said battery box, with said lamp socket and said hood being separately stored in said storage spaces.

11. An assembly according to claim 4 wherein the article comprises a battery box having sides and ends centrally located within said base and providing a side storage space at each side of said battery box and an end storage space at each end of said battery box, a lamp socket stored in one of said side storage spaces, and a control switch fixedly mounted in one of said end storage spaces.

12. An assembly according to claim 11 wherein said control switch also includes an external AC connector.

13. An assembly comprising a hollow base and a removable cover, a lamp unit stored within said base for use when said cover is removed, and cooperating means on said base and said cover for mounting said base on a wall formed of a material such as cloth and fabric with the wall disposed between the base and the cover.

14. An assembly according to claim 13 wherein there is a battery box having sides and ends centrally located within said base and providing a side storage space at each side of said battery box and an end storage space at each end of said battery box, a lamp socket stored in one of said side storage spaces, and a control switch fixedly mounted in one of said end storage spaces.

15. An assembly according to claim 14 wherein said control switch also includes an external AC connector.

16. An assembly particularly adapted for mounting a lamp unit on a wall formed of a flexible panel, said assembly comprising a lamp unit carried by a supporting base, and a cover for said base, each of said cover and said base having magnetic properties, said cover and said base in cooperation with one another forming means for mounting said lamp unit on said wall.

17. An assembly according to claim 16 wherein said base is hollow and of a size and shape to receive therein said lamp unit in its entirety and said cover is engageable with said base to completely enclose said article for transport and storage.

18. An assembly according to claim 16 wherein said cover is generally cup shaped with a top wall and has a magnet engaging said top wall externally of said cover.

19. An assembly according to claim 18 wherein said base is hollow and includes a recessed bottom wall, and a magnet is seated in the recessed bottom wall externally of said base.

* * * * *